US006130372A

United States Patent [19]

Petersen

[11] Patent Number: 6,130,372

[45] Date of Patent: Oct. 10, 2000

[54] STRIKING MECHANISM FOR A STRING INSTRUMENT

[76] Inventor: Erik Ingvor Petersen, Frederiksborggade 36, 2. tv., Copenhagen K, Denmark, 1360

[21] Appl. No.: 09/254,037

[22] PCT Filed: Aug. 21, 1997

[86] PCT No.: PCT/DK97/00338

§ 371 Date: Feb. 26, 1999

§ 102(e) Date: Feb. 26, 1999

[87] PCT Pub. No.: WO98/10409

PCT Pub. Date: Mar. 12, 1998

[30] Foreign Application Priority Data

Sep. 2, 1996 [SE] Sweden ..... 0935

[51] Int. Cl.[7] ..... G10C 3/18

[52] U.S. Cl. ..... 84/254; 84/253

[58] Field of Search ..... 84/254, 253, 251, 84/252, 250

[56] References Cited

U.S. PATENT DOCUMENTS 3,979,990 9/1976 Hinago ..... 84/719

5,505,115 4/1996 Vandervoort ..... 84/423 R

*Primary Examiner*—Paul Ip

*Assistant Examiner*—Kim Lockett

*Attorney, Agent, or Firm*—Pennie & Edmonds LLP

[57] ABSTRACT

A striking mechanism for a string instrument, such as a piano or a grand piano, which has, for each string, a hammer, which, via a power transmission, is brought to strike the string when the associated key in the keyboard of the instrument is depressed. The mechanism includes first and second checks having, respectively, first and second check zones for, in mutual engagement, stopping and temporarily retaining the hammer during rebound. A magnetic or magnetizable material is placed in each check zone to generate a magnetic field which causes the hammer during rebound to obtain a much safer and softer braking than is the case in conventional striking mechanism. Thus, the risk of the hammer rebounding and striking the string in an unintended repetition strike is eliminated.

9 Claims, 3 Drawing Sheets

1
2
3
4
5
6
7
8
9
10
11
12
13
14
15
16
17
18
19
20
21
22
23
24
25
26
27
28
29
30
31
32
33
34
35

STRIKING MECHANISM FOR A STRING INSTRUMENT

TECHNICAL FIELD

The invention concerns a striking mechanism for a string instrument, such as a piano or grand piano, and of the kind which comprises, for each string, a hammer which is made to strike the string via a power transmission when the associated key in the keyboard of the instrument is depressed, and also with a first and a second check having, respectively, a first and a second check zone for, in mutual engagement, stopping and temporarily retaining the hammer during rebound for as long as the associated key is depressed.

BACKGROUND ART

When the hammer of such string instruments has struck the string, it must be caught at a certain position during rebound. In conventional string instruments, the hammer is caught at a relatively great distance from the string.

The applicant's European Patent No. EP 0 500 701 B1, which is incorporated into the present patent application as reference, discloses a striking mechanism in which it is possible to catch the hammer at a relatively short distance from the string so that the strike can be repeated immediately.

Anyhow, it is important that the hammer is caught in such a way during rebound that it does not jump back and thereby spontaneously hits the string in an unintended repetition strike.

The catching of the hammer conventionally takes place when the check zone of one of the checks collides with the check zone of the other check resulting in a relatively sudden stopping of the swinging parts. Due to the inertia of the system, tensions arise in the rod system of the striking mechanism. The resultant of these tensions acts in the opposite direction of the rebound and will therefore, in some cases, be able to provoke the above-mentioned unintended repetition strike. Evidently, the risk is greatest when the catching of the hammer takes place near the string as is the case in the known structure of the applicant's above-mentioned EP Patent.

A known method for preventing the hammer, on the catching, from jumping so far back that it can restrike the string is to put a buffer in the form of usually a piece of soft felt between the check zones of the checks. Thereby, the braking of the swinging masses of the mechanism is softened, and the reactive forces in the resilient rod system of the striking mechanism become correspondingly smaller whereby the risk of the hammer being thrown back at the string is reduced.

However, it has appeared that even with, for example, a layer of felt between the check zones, unintended repetition strikes may occur. The reason for this is that it is not constructively possible to attain a sufficiently long braking length by, in this way, only mechanically braking the rebound.

SUMMARY OF THE INVENTION

The object of the invention is to show a striking mechanism of the type mentioned in the opening paragraph which is able to catch the hammer during rebound more safely and with a softer braking than known so far.

This is, according to the invention, achieved by the fact that, on each check zones, a magnetic or magnetizable material is placed. Now, the braking length is no longer determined by the limited thickness and compressibility of solid materials but by the extent of the magnetic field which now is present between the two check zones. This magnetic field has, in principle, an unlimited extent and can, without difficulties, be provided with sufficient strength to be able to start the braking operation already at a relatively great distance from the two check zones. The braking length is therefore long and the braking soft. At the same time, the braking is safe since the strength of the magnetic field increases by the square of the distance between the check zones.

At the final position, the two check zones can engage with each other along an outer surface on each zone. Some of the magnets or magnetic material can then be placed flushing with the respective outer surface, whereby the two check zones can accidentally hit each other during rebound with a usually undesirable, metallic sound. To efficiently eliminate this inconvenience, there can, along the outer side of at least one of the check zones, be placed a relatively thin layer of an elastically deformable, relatively soft, noise-reducing material, e.g. felt which, at the same time, contributes positively to the braking operation.

The magnetic field can be created by a magnet in one of the check zones and a piece of magnetizable material, for example soft iron, in the other one, but also by a magnet in each of the check zones. In the last-mentioned case, the magnets can, depending on the more definite arrangement of the striking mechanism, be of opposite or of identical polarity at the outer side of the check zones.

Advantageous embodiments for a grand piano and a piano, respectively, are specified in the claims.

BRIEF DESCRIPTION OF THE DRAWINGS

The invention will be explained in greater details below, describing only exemplary embodiments with reference to the drawing, in which.

DETAILED DESCRIPTION OF THE PREFERRED EMBODIMENTS

Figure 1:
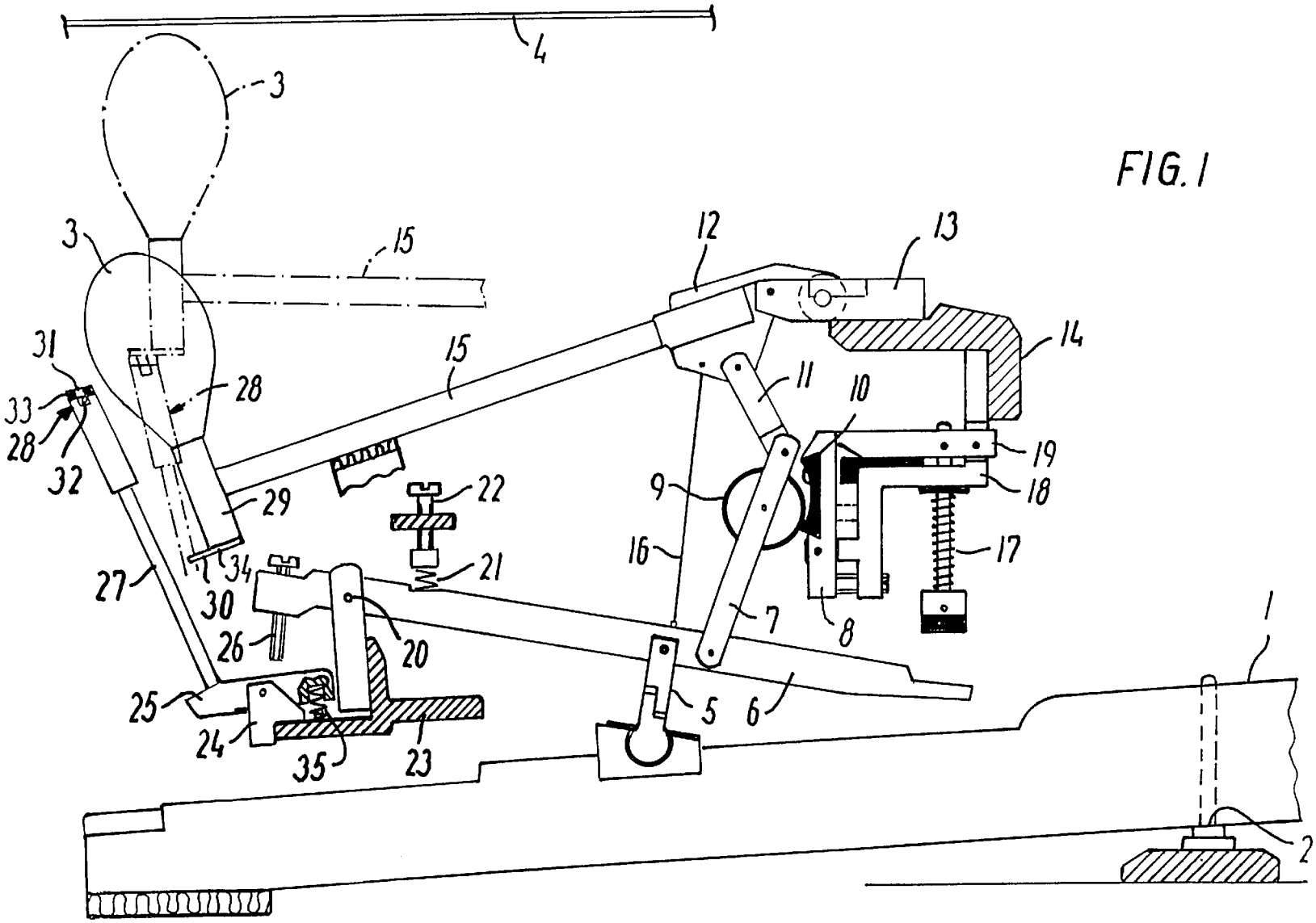
FIG. 1 shows, seen from the side and partly in section, one single striking mechanism according to the invention for a grand piano.

In FIG. 1 is seen a striking mechanism for a grand piano of the type stated in the applicant's European Patent No. EP 0 500 701 B1. The mechanism is activated by depressing the partially shown key 1 in front which thereby tilts round a bearing 2 and lifts the hammer 3 to strike against the string 4 via the shown power transmission. In the figure, the hammer is shown in full line in rest postition and in a dotted line immediately before or after the strike.

The power transmission comprises a lever 6 which, via a knee joint which is comprised of an intermediate rod 7, and an upper rod 11, can lift a hammer butt 12 with a hammer shank 15 which carries the hammer 3 which thereby is brought to strike the string 4. The hammer is swingably mounted on a bearing cap 13 which is fastened upon a fixed part 14 of the grand piano.

The knee joint 7, 11 is supported against bending out by a roller 9 which again is controlled by a curve guide 10 on a curve element 8. A connecting line 16 serves to hold the hammer butt 12 in tight connection with the lever 6 during the whole strike and rebound operation.

The striking mechanism furthermore comprises a release mechanism which consists of a holder 18 mounted upon the fixed part 14 and which carries a release arm 17 which, by means of a release pawl 19, permits the curve guide 10, in engagement with the roller 9, to fall back to a predetermined position as an end piece on the lever 6 lifts the release arm 17. This release takes place when the hammer is close to the key and permits the hammer to return.

The specific functioning of the striking mechanism appears from the applicant's above-mentioned EP Patent, to which reference is made in this connection.

The lever can tilt round a bearing 20 and is tightened into the rest position by a pressure spring 21 whose spring tension can be adjusted by means of a screw 22.

The bearing is fitted on a fixed grand piano part 23 which, at the same time, carries a bearing 24 for a rocker arm 25. By means of an adjustment screw 26 at the end of the lever 6 the motion of the latter can be transmitted to the rocker arm 25.

On the opposite side of the bearing 24, the rocker arm 25 carries a first check in the form of an upwards turning rod with the first check zone situated at the upper end of the rod. When the key 1 is depressed, the check rod 27 with the check zone 28 will be lifted and turned with a gear corresponding to the ratio between the shorter distance from the bearing 24 to the point of attack of the screw on the rocker arm 25 and the greater distance from the bearing 24 to the placing of the check rod 27 upon this arm.

The other check 29 has the shape of a downwards turning, check rod on the hammer with the second check zone 30 placed at the lower end of the check rod.

In a recess 31 on the check zone 28 of the check rod 27, a magnet 32 is fitted. A ring 33 of felt or another soft material having an opening corresponding to that of the magnet 32 is fitted on the magnet 32. Furthermore, a piece of soft iron 34 is fitted on the check zone 30 of the other check rod 29, the iron can be shaped as a wire bow.

Immediately before or after the hammer 3 has struck the string 4, the check zone 28 of the first check rod 27 with the magnet 32 is lifted and swung under the check zone 30 of the second check rod 29 with the piece of soft iron 34. The above described gear ensures that the two check zones are guided towards each other at a very high speed.

The magnetic field between the magnet and the piece of soft iron will now start to brake the rebound of the hammer already at a great distance. Initially, the strength of the magnetic field is relatively weak, however, it increases by the square as the distance between the two magnetic parts decreases. Thereby, a very soft, and at the same time, efficient braking of the hammer is obtained, so the hammer is not liable to jump back restriking the string in an unintended repetition strike as is the case in conventional grand pianos.

The ring 33 of felt or similar material prevents the two magnetic parts 32, 34 from hitting each other with a noisy, metallic sound. At the same time, the felt ring helps to ultimately brake the rebound of the hammer.

It has to be noted that the structure can also be arranged so that the two magnetic parts 32, 34 only are able to get close to each other but not mutually touch each other. In this case, there is no need for a felt ring in between.

When a magnet is placed on the first check zone and a piece of soft iron on the other one, the two check zones will interact by means of a force of attraction. The same is the case when another magnet has been placed on the second check zone and when the poles of the two magnets facing each other are of opposite polarity so that the magnets attract each other.

In both cases, the hammer will, via the second check zone both with or without the intermediate layer of felt, be supported by the second check zone which, at the same time, holds the hammer by means of a magnetic attraction. Therefore, the hammer cannot move either up or down before the pressure on the key has been relieved. Thereby, the person playing the grand piano obtains an unprecedented security against unintended repetition strikes. This safeguard is especially of great importance when the hammer is to be caught near the string as is the case in the known structure of the applicant's above-mentioned EP Patent.

When magnets have been placed on both check zones and when those of the two magnet poles facing each other are of similar polarity, the two check zones will affect each other with a repulsive power which increases by the square concurrently with the two zones approaching each other during rebound. Thereby, a very soft, and at the same time, efficient braking is obtained, since the magnetic field now affects the hammer with forces in the opposite direction than the rebound direction of the hammer.

It has to be noted that the structure of the striking mechanism has to be adjusted specifically to having either an attractive force or a repulsive power at the check zones.

A pressure spring 35 between the rocker arm 25 and the fixed grand piano part 23 serves to quickly and safely removing the check zone 28 of the first check rod 27 from the second check zone 30 when the pressure of the finger on the key is relieved so that the hammer is able to strike the string once more.

Figure 2:
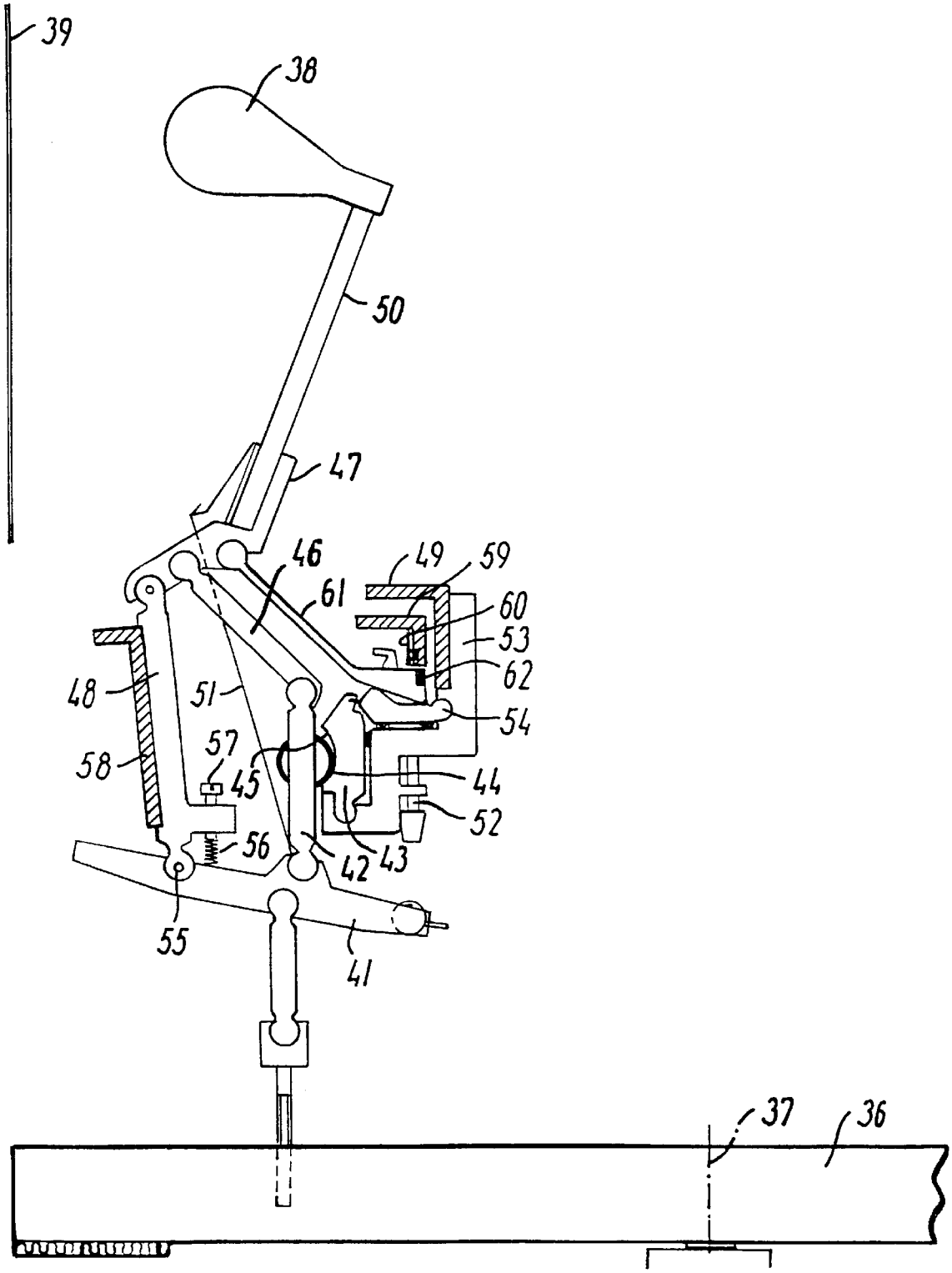
FIG. 2 is a side view, partly in section, of a single striking mechanism according to the invention for a piano, and FIG. 3*a,b,c* show, in fragments, a first and second check associated to the striking mechanism shown in FIG. 2 in three successive positions at the catching of the hammer.

In FIG. 2 is seen a striking mechanism for a piano of the type stated in the applicant's European Patent No. EP 0 500 701 B1. The mechanism is activated by depressing the partially shown key 36 in front which thereby tilts round a bearing 37 and swings the hammer 38 to strike the string 39 via the shown power transmission.

The power transmission comprises a lever 41 which, via a knee joint comprised of an intermediate rod 42 and an upper rod 46, can lift a hammer butt 47 with a hammer shank 50 which carries the hammer 38 which thereby is brought to strike the string 39. The hammer is swingably mounted on a bearing cap 48 which is mounted on a fixed instrument part 58 of the piano.

The knee joint 42, 46 is supported against bending out by a roller 44 which again is controlled by a curve guide 45 on a curve element 43. A connecting line 51 serves to hold the hammer butt 47 in tight connection with the lever 41 during the whole strike and rebound operation.

The striking mechanism furthermore comprises a release mechanism which consists of a fixture 53 which is mounted on the fixed piano part 49 and supports a release arm 52 for swinging a release pawl 54 free of the curve guide 45 which thereby can fall back to a predetermined position. The release arm 52 is itself lifted by an end piece on the lever 41 and the release takes place when the hammer is close to the key and permits the hammer to return.

The specific functioning of the striking mechanism appears from the applicant's above-mentioned EP Patent, to which reference is made in this connection.

The lever can tilt round a bearing 55 and is tightened down to the rest position by a pressure spring 56 whose spring tension can be adjusted by means of a screw 57. The bearing 55 is fitted on a bearing cap 48 which again is placed on a fixed piano part 58.

The first check 59 of the piano is shaped as a check strip 59 which stretches across all the hammer sets. At each of these sets there is a first check zone 60.

The second check 61 is shaped as a check rod 61 whose end, situated nearest the first check zone 60, carries the second check zone 62, and whose other end is swingably connected to the hammer butt 47.

Figure 3A:
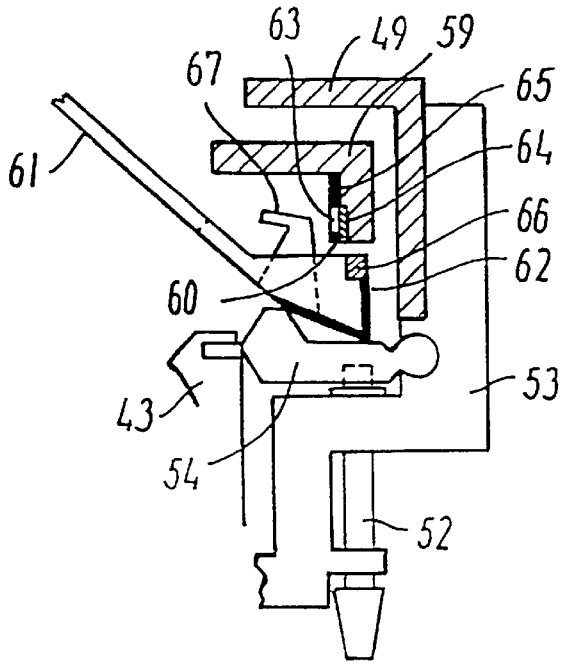
Figure 3B:
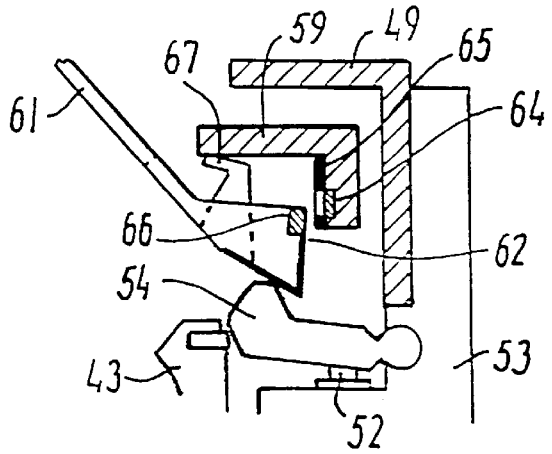
Figure 3C:
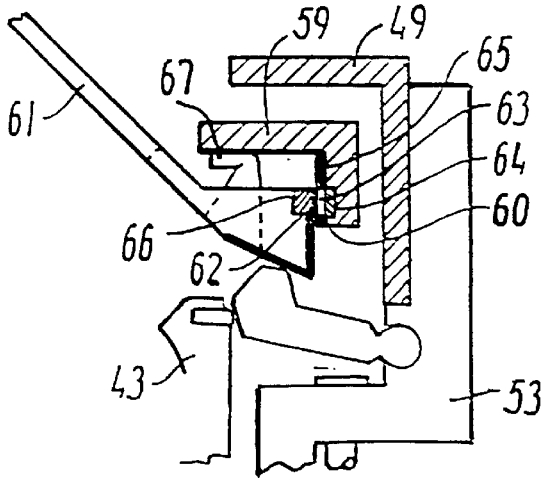

As best seen in FIG. 3 *a, b, c,* a recess 63 with a magnet 64 upon which is laid a ring 65 of felt or another soft material is formed on the check zone 60 of the check strip 59. A piece of soft iron 66 has furthermore been placed on the check zone 62 of the check rod 61. It is obvious that the magnet 64 and the piece of soft iron 66 can be placed reversely on the check zone 62 and the check zone 60 respectively.

In FIG. 3*a,* the hammer 38 is at the start of the striking position. The release which permits the hammer to return takes place, as mentioned earlier, by the release pawl 54 being swung free off the curve guide 45 when it is lifted by an end piece on the lever 41.

This stage of the operation is seen in FIG. 3*b,* which, at the same time, shows that the release pawl 54 swings the check zone 62 of the check rod 61 up towards the first check zone 60 on the check strip 59.

The magnetic field between the magnet and the piece of soft iron will now, already from a distance, start to brake the rebound of the hammer. Initially, with a relatively weak force which, however, is increased by the square, as the distance between the two magnetic parts decreases. Thereby, a very soft, and at the same time, efficient braking of the hammer is obtained, the hammer is therefore not liable to jump back restriking the string in an unintended repetition strike, as is the case in conventional pianos.

The felt ring 65 prevents the two magnetic parts 64, 66 from hitting each other with a noisy, metallic sound. At the same time, the felt ring helps to ultimately brake the rebound of the hammer.

It has to be noted that the structure can also be arranged so that the two magnetic parts 64, 66 can only get close to each other but not mutually touch each other. In this case, there is no need for a felt ring in between.

When a magnet is placed on the first check zone and a piece of soft iron on the other, the two check zones will interact through a force of attraction. The same is the case if another magnet has also been mounted on the second check zone, and if those of the two magnets' poles facing each other are of opposite polarity so that the magnets attract each other.

When magnets have been placed on both check zones and when the two magnet poles facing each other are of identical polarity, the two check zones will affect each other with a repulsive power which increases by the square concurrently with the two zones approaching each other during rebound. Thereby, a very soft, and at the same time, efficient braking is obtained, since the magnetic field now affects the hammer with forces in the opposite direction than the rebound direction of the hammer.

Between the check strip 59 and the check rod 6, a resilient unit 67 of e.g. rubber has been fitted, the unit serves to quickly and safely remove the check zone 62 of the check rod from the check zone 60 of the check strip, when the pressure of the finger on the key is released so that the hammer is able to strike the string once more.

To efficiently ensure that the two check zones easily and unencumbered can be seperated after the catching of the hammer, the outer surfaces of the two zones have, compared to the swing direction, an inclination which has the effect of also removing the outer surface of the second zone transeversely to the outer surface of the first check when the second check returns to its starting position.

What is claimed is:

1. A striking mechanism for a string instrument having a plurality of strings, a keyboard having a plurality of keys and a plurality of hammers where a hammer strikes a string when an associated key of the keyboard is depressed, the striking mechanism comprising:

a power transmitter located between the key and the hammer and comprising a lower rod downwardly resting against an abutment on the key and swingably connected to a fixed instrument part by a rearwardly extending arm, an upper rod upwardly connected swingably with the hammer, and at least one intermediate rod swingably connected with the other rods;

first and second checks having, respectively, first and second check zones for, in mutual engagement, stopping and temporarily retaining the hammer during rebound for as long as the associated key is depressed;

a first magnetic or magnetizable material mounted on the first check zone and facing the second check zone; and a second magnetic or magnetizable material arranged on the first check zone such that the second material attracts the first material on the first check zone.

2. A striking mechanism according to claim 1 wherein the first magnetic material is a magnet and the second magnetic material is a piece of magnetizable material.

3. A striking mechanism according to claim 1 wherein each of the check zones include magnets which are positioned and arranged such that the poles of the magnets, facing each other, are of opposite polarity.

4. A striking mechanism according to claim 1 wherein a layer of an elastically deformable, noise-reducing material is present on at least one of the check zones.

5. A striking mechanism according to claim 1 for a string instrument in the form of a grand piano, wherein the first check is a first swingably placed, upwards turning check rod having the first check zone placed near its upper end, and the second check is a downwards turning, second check rod on the hammer having the second check zone placed near its lower end, whereby the striking mechanism is arranged so as to bring the two check zones into mutual engagement when the hammer during rebound is close to the string.

6. A striking mechanism according to claim 5, wherein the first check is placed on one end of a substantially horizontally extending rocker arm, the other end of which is pressed down by the power transmitter when the hammer is close to the string.

7. A striking mechanism according to claim 1 for a string instrument in the form of a piano, wherein the first check with the first check zones is a strip extending crosswise across the hammers, the second check is a rod which is swingably connected to the hammer and has the second check zone at the end opposite to the hammer, whereby the striking mechanism is arranged to bring the two check zones into mutual engagement when the hammer during rebound is close to the string.

8. A striking mechanism according to claim 7 wherein an elastic, compressible, damping unit is fitted between the second check and the fixed instrument part of the piano.

9. A striking mechanism according to claim 7 wherein the outer surfaces of the zones facing each other are flush with each other at the engagement position and that they, in this position in relation to the swing direction, have an inclination causing the outer surface of the second zone also to be removed crosswise to the outer surface of the first check when the second check returns to its starting position.

* * * * *